US006785505B2

(12) United States Patent
Yasui et al.

(10) Patent No.: US 6,785,505 B2
(45) Date of Patent: Aug. 31, 2004

(54) FIXING DEVICE PREVENTING RUBBING OF TONER IMAGE

(75) Inventors: Motokazu Yasui, Kanagawa (JP); Masanao Ehara, Saitama (JP); Hideo Furukawa, Kanagawa (JP); Hiroshi Yoshinaga, Chiba (JP); Hirofumi Ogawa, Kanagawa (JP); Hiroyuki Gotoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/464,500

(22) Filed: Jun. 19, 2003

(65) Prior Publication Data

US 2003/0206758 A1 Nov. 6, 2003

Related U.S. Application Data

(63) Continuation of application No. 09/988,703, filed on Nov. 20, 2001, now Pat. No. 6,628,916.

(30) Foreign Application Priority Data

Nov. 24, 2000 (JP) ..... 2000-357039

(51) Int. Cl.[7] ..... G03G 15/20

(52) U.S. Cl. ..... 399/329; 219/216; 329/122; 329/322

(58) Field of Search ..... 399/329, 120, 399/320, 322, 122; 219/216; 432/59, 60; 430/124

(56) References Cited

U.S. PATENT DOCUMENTS

| | | | | |
|---|---|---|---|---|
| 4,682,878 A | | 7/1987 | Takizawa et al. | |
| 5,164,782 A | | 11/1992 | Nagayama et al. | |
| 5,481,350 A | | 1/1996 | Yasui et al. | |
| 5,729,798 A | | 3/1998 | Yasui et al. | |
| 5,745,247 A | | 4/1998 | Yasui et al. | |
| 5,832,354 A | | 11/1998 | Kouno et al. | |
| 5,873,020 A | | 2/1999 | Matsuura et al. | |
| 5,915,147 A | | 6/1999 | Kouno et al. | |
| 6,026,274 A | | 2/2000 | Aslam et al. | |
| 6,078,766 A | | 6/2000 | Kurotaka | |
| 6,219,520 B1 | | 4/2001 | Ehara | |
| 6,628,916 B2 | * | 9/2003 | Yasui et al. | 399/329 |
| 2001/0003562 A1 | | 6/2001 | Hachisuka et al. | |

FOREIGN PATENT DOCUMENTS

| | | |
|---|---|---|
| EP | 0 930 548 | 7/1999 |
| JP | 05019648 | 1/1993 |

* cited by examiner

*Primary Examiner*—Robert Beatty
(74) *Attorney, Agent, or Firm*—Oblon, Spivak, McClelland, Maier & Neustadt, P.C.

(57) ABSTRACT

A fixing device includes an abutting member arranged at a position between an upstream side of a fixing roller and a downstream side of a heating roller in a moving direction of a fixing belt so as to abut against the fixing belt and expand a fixing region. The fixing device may also include a first supporting member and a second supporting member, which supports the fixing belt, etc., with respect to the first supporting member. An angle, formed between an approaching direction of a sheet-like recording medium and a line tangential to an upstream end of the fixing region in the moving direction of the fixing belt, is set equal to 20° or larger.

8 Claims, 4 Drawing Sheets

FIG, 2

FIXING DEVICE PREVENTING RUBBING OF TONER IMAGE

CROSS-REFERENCE TO RELATED APPLICATIONS

This application is a continuation of Ser. No. 09/988,703 filed Nov. 20, 2001 now U.S. Pat. No. 6,628,916.

This application is related to and claims priority, under 35 U.S.C. §119, from Japanese Patent Application No. 2000-357039, filed on Nov. 24, 2000, the entire contents of which is hereby incorporated by reference herein.

BACKGROUND OF THE INVENTION

1. Field of the Invention

The present invention relates to a fixing device to be used in an image forming apparatus, such as a copying machine, a facsimile, a printer, and other similar devices, and more particularly, to a belt-type fixing device that can prevent a fixing belt of the fixing device from rubbing against the toner image.

2. Discussion of Background

Generally, an image forming apparatus, such as a copying machine, facsimile, printer, and a printing machine, includes a fixing device that fixes a toner image on a sheet-like recording medium. The sheet-like recording medium may be a normal recording medium, such as plain paper, which is generally used for copying. Instead, the sheet-like recording medium may be a special recording medium, such as overhead transparency film sheets, pieces of cardboard, envelopes, and other similar special recording medium on which images can be recorded, having a greater thermal capacity than the thermal capacity of the normal recording medium.

Two types of fixing devices are commonly known. A first type of fixing device is referred to as a heating roller type. A second type of fixing device is referred to as a belt type.

A heating roller type fixing device is typically comprised of a heating roller, which has a heating source inside thereof and which is rotatably driven, and a pressure roller, which is in pressure-contact with the heating roller and which is driven by the heating roller. In the heating roller type fixing device, a sheet-like recording medium is conveyed by the heating roller and pressure roller to a nip formed between the heating roller and the pressure roller. A toner image is fixed in the nip by heat and pressure.

A belt type fixing device is typically comprised of an endless fixing belt, which conveys the sheet-like recording medium, a heating roller and a fixing roller on which the fixing belt is spanned, and a pressure roller provided at a position opposed to the fixing roller via the fixing belt.

In the heating roller type fixing device, rubbing of the toner image does not occur unless the toner image, formed on a sheet-like recording medium, touches either the surface of the heating roller or the pressure roller before the sheet-like recording medium is conveyed into the nip formed between the heating roller and the pressure roller.

In the belt type fixing device, rubbing of the toner image is more likely to occur because the fixing belt is extended to an upstream side of a fixing region, in which the pressure roller abuts against the fixing belt, in a conveying direction of the sheet-like recording medium so that the toner image is disturbed.

The reasons why the toner image touches the fixing belt are, as follows: (1) a precise setting of a spanning direction of the fixing belt at the upstream side of the fixing region in the conveying direction of the sheet-like recording medium is not easily performed; and (2) the spanning direction of the fixing belt and the conveying direction of the sheet-like recording medium have not been considered in relation to the problem of the toner rubbing.

SUMMARY OF THE INVENTION

The present invention has been made in view of the above-mentioned and other problems and addresses the above-discussed and other problems.

The present invention advantageously provides a novel fixing device wherein a rubbing of a toner image by a fixing belt is prevented by precisely setting a spanning direction of the fixing belt and by setting an angle formed between the spanning direction of the fixing belt and an approaching direction of a sheet-like recording medium.

According to an example of the present invention, a fixing device includes: a fixing belt, in an endless form, to convey a sheet-like recording medium on which a toner image is fixed; a heating roller and a fixing roller for supporting the fixing belt; a pressure roller provided at a position opposed to the fixing roller so as to pass the fixing belt between the pressure roller and the fixing roller; a first fixing region where the pressure roller opposes only the fixing belt; a second fixing region arranged at downstream side of the first fixing region in a moving direction of the fixing belt where the pressure roller opposes both the fixing belt and the fixing roller; and an abutting member, which abuts against the fixing belt, provided at a position between an upstream side of the fixing roller and a downstream side of the heating roller in the moving direction of the fixing belt so as to expand the first fixing region.

According to another example of the present invention, the fixing device includes: a fixing belt, in an endless form, to convey a sheet-like recording medium on which a toner image is fixed; a heating roller and a fixing roller for supporting the fixing belt; a pressure roller provided at a position opposed to the fixing roller so as to pass the fixing belt between the pressure roller and the fixing roller; a first supporting member to support the pressure roller with respect to a main body of the fixing device; and a second supporting member to support the fixing belt, the heating roller, and the fixing roller with respect to the first supporting member.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
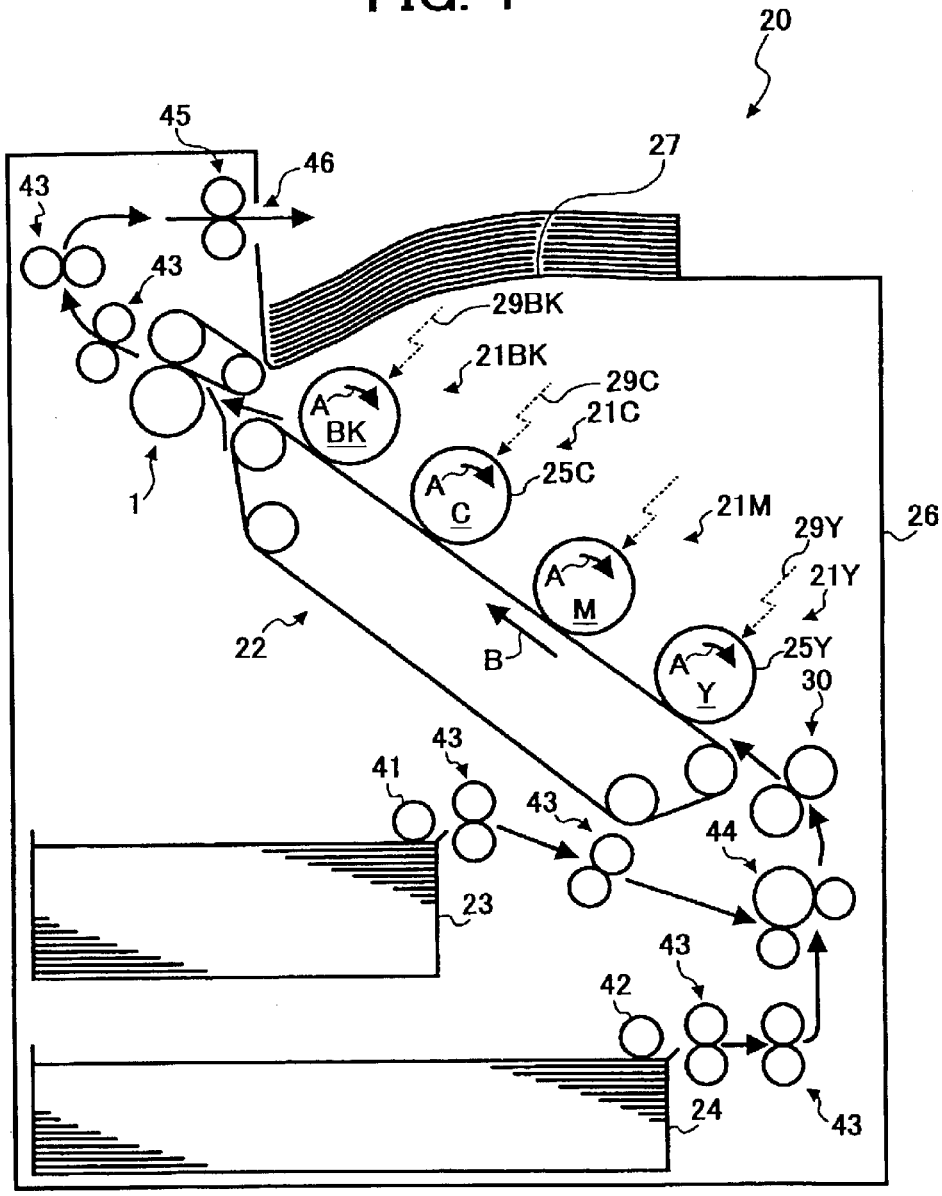
FIG. 1 is a schematic drawing illustrating a fixing device to which the present invention is applied and an image forming apparatus using the fixing device.

Referring now to the drawings, wherein like reference numerals designate identical or corresponding parts throughout the several views, FIG. 1 is a schematic drawing illustrating a fixing device to which the present invention is applied and an image forming apparatus using the fixing device. A copying machine, a facsimile, a printer, and other similar devices are commonly known as examples of an image forming apparatus. However, an image forming apparatus may include any type of apparatus that can use the fixing device according to the present invention. The image forming apparatus according to an example of the present invention is capable of forming a color image.

Referring to FIG. 1, the image forming apparatus 20 includes: image forming devices 21Y, 21M, 21C, and 21BK; and a transfer device 22 arranged at a position opposed to the image forming devices 21Y, 21M, 21C, and 21BK. The image forming apparatus 20 further includes sheet feeding cassettes 23 and 24, a registration roller 30, and a fixing device 1. The sheet feeding cassettes 23 and 24 feed various types of sheet-like recording media to a transfer region formed at a position where the transfer device 22 opposes the respective image forming devices 21Y, 21M, 21C and 21BK. The registration roller 30 feeds the sheet-like recording medium, conveyed from the sheet feeding cassettes 23 and 24, to the transfer region by adjusting a time such that the sheet-like recording medium is in precise registration with images formed by the image forming devices 21Y, 21M, 21C and 21BK.

In the image forming apparatus 20, either a normal recording medium or a special recording medium may be used. A normal recording medium is, for example, plain paper, such as is generally used in a copier (hereinafter referred to as a normal recording medium). On the other hand, special recording medium is, for example, an overhead transparency film sheet, a card, a postcard, a thick paper having a basis weight of about 100 g/m2 or greater, and an envelope (hereinafter referred to as a special recording medium). The special recording medium generally have a greater thermal capacity than the thermal capacity of the normal recording medium.

The image forming devices 21Y, 21M, 21C, and 21BK form yellow, magenta, cyan, and black-and-white toner images, respectively. Because their configurations are substantially the same except for the color of toner to be used, the configuration of the image forming device 21C is described below as an example of the image forming device. The image forming device 21C includes a photoconductive drum 25C as an electrostatic latent image bearing member. A commonly known charging device, developing device, cleaning device, and so forth (not shown) are arranged around the photoconductive drum 25C in the order of the rotating direction of the photoconductive drum 25C indicated by an arrow "A." A surface of the photoconductive drum 25C is exposed to an exposure light 29C emitted from a scanning device (not shown), such as a polygon mirror which is provided between the charging device and the developing device. A belt-shaped photoconductive element may be employed as the electrostatic latent image bearing member instead of the drum-shaped photoconductive element. In the image forming device 21BK, two beam lights 29BK are emitted such that an image is formed quickly compared to an image forming operation performed in other image forming devices 21Y, 21M, and 21C.

A-4 size and A-3 size sheet-like recording media are longitudinally loaded in a horizontal direction in FIG. 1 in the sheet feeding cassettes 23 and 24, respectively. The transfer device 22 is arranged in an oblique direction such that the image forming apparatus 20 is downsized in the horizontal direction in FIG. 1. Thus, the sheet-like recording medium is conveyed in the oblique direction as indicated by an arrow "B." With this arrangement, a width of a housing 26 is reduced to a size which is slightly greater than the longitudinal length of the A-3 size sheet-like recording medium. Namely, the image forming apparatus 20 is downsized such that it has a minimum necessary size to contain the sheet-like recording medium inside. A sheet discharge tray 27 is formed in the top surface of the housing 26 to stack the sheet-like recording medium having a toner image fixed by the fixing device 1.

In FIG. 1, reference numerals 41 and 42 each denote a pickup roller to feed the sheet-like recording media from the sheet feeding cassettes 23 and 24, respectively. Reference numerals 43 and 44 each denote a conveying roller conveying the sheet-like recording medium and a roller mechanism which feeds the sheet-like recording medium conveyed from the sheet feeding cassettes 23 and 24 to the registration roller 30. A reference numeral 45 denotes a discharging roller to discharge the sheet-like recording medium to the sheet discharge tray 27 from a sheet discharging outlet 46.

Figure 2:
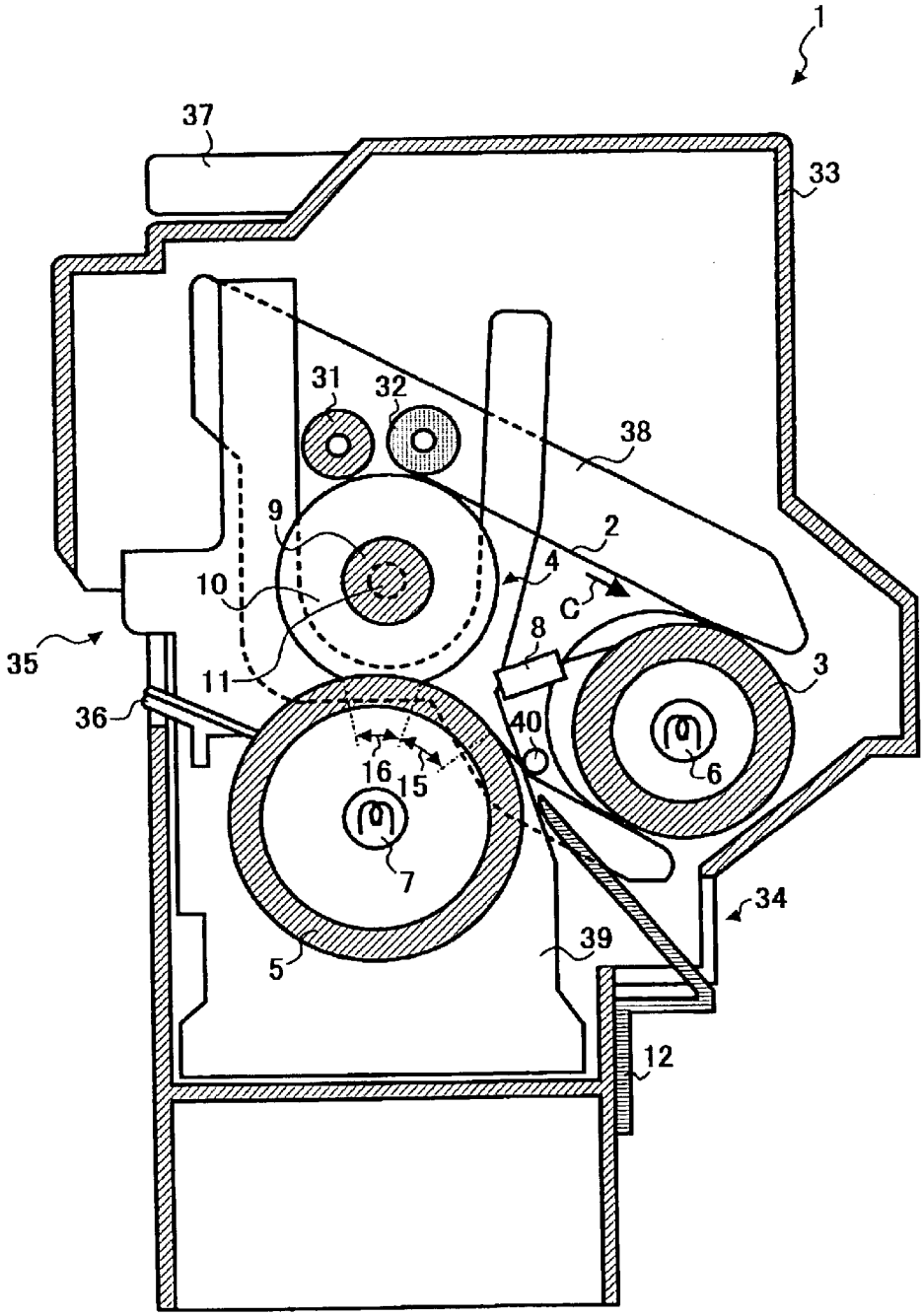
FIG. 2 is a cross-sectional side view illustrating the fixing device illustrated in FIG. 1.

As illustrated in FIG. 2, the fixing device 1 includes an endless fixing belt 2, a heating roller 3, a fixing roller 4, a roller-shaped abutting member 40, a pressure roller 5, heaters 6 and 7, and a thermistor 8. The endless fixing belt 2 conveys the sheet-like recording medium for fixing a toner image thereon. The fixing belt 2 is spanned around the heating roller 3. The pressure roller 5 is arranged at a position opposed to the fixing roller 4 via the fixing belt 2. The heaters 6 and 7 are provided inside the heating roller 3 and pressure roller 5, respectively. The thermistor 8 is arranged at a position opposed to the heating roller 3 to abut against the heating roller 3. The thermistor 8 detects a temperature of the heating roller 3 (i.e., a temperature detecting device). The fixing device 1 further includes a cleaning roller 31, a coating roller 32, a casing 33, an inlet guide 12, an outlet guide 36, a handle 37, and first and second supporting members 39 and 38. The cleaning roller 31 is provided at a position opposed to the fixing roller 4 via the fixing belt 2. The coating roller 32 coats a release agent. The inlet and outlet guides 12 and 36 are fixedly provided on the casing 33 as guiding members. The first supporting member 39 supports the pressure roller 5 with respect to the casing 33. The second supporting member 38 integrally supports the heating roller 3, fixing roller 4, and a fixing belt 2 with respect to the first supporting member 39.

In order to give a predetermined suitable tension on the fixing belt 2, the heating roller 3 is biased in a direction away from the fixing roller 4 by a resilient member (not shown), such as a spring. The fixing roller 4 includes a core metal 9 and a heat-resistant elastic layer 10 which covers the core metal 9. A shaft 11 is rotatably driven by a driving device (not shown), thereby rotatably driving the core metal 9. Thus, the fixing roller 4 is rotatably driven. The fixing roller 4 rotatably drives the heating roller 3, thereby driving the fixing belt 2.

The first and second supporting members 39 and 38 are attachable/detachable to the fixing device 1, while the first supporting member 39 is supporting the pressure roller 5, and the second supporting member 38 is supporting the heating roller 3, the fixing roller 4, the abutting member 40, and the fixing belt 2. The first and second supporting members are provided in a pair in a vertical direction as shown in FIG. 2. The first supporting member 39 supports the end portions of the pressure roller 5. The second supporting member 38 supports the end portions of the heating roller 3, etc. In assembling the fixing device 1, the pressure roller 5 is properly positioned when the first supporting member, which supports the pressure roller 5, is set to a predetermined position in the casing 33. The heating roller 3, the fixing roller 4, the abutting member 40, and the fixing belt 2 are positioned with reference to the position of the pressure roller 5. The first supporting member 39 includes a U-shaped portion. The fixing roller 4, which is supported by the second supporting member 38, is fitted into the U-shaped portion such that the fixing roller 4 is engaged with the pressure roller 5 via the fixing belt 2 from approximately above the pressure roller 5.

While maintaining engagement of the fixing roller 4 with the pressure roller 5, the second supporting member 38 is pivoted about the fixing roller 4 with respect to the first supporting member 39, thereby precisely positioning the pressure roller 3, the abutting member 40, and the fixing belt 2. A portion of the fixing belt 2, which abuts against the abutting member 40, is separated at a minute distance from the pressure roller 5. However, such a precise positioning can be efficiently performed with the above-described configuration.

The heating roller 3, the fixing roller 4, the abutting member 40, and the fixing belt 2 are integrally attachable/detachable to the second supporting member 38, while the second supporting member 38 is detached from a main body of the fixing device 1. Thus, when at least one of the heating roller 3, the fixing roller 4, the abutting member 40, and the fixing belt 2 is replaced with a new one, these components can integrally be separated from the second supporting member 38, thereby increasing efficiency of the work. The abutting member 40 may be configured such that it is not separated integrally from the other components. These components may be unitized such that these components are integrally separated from the second supporting member 38 as a unit to be replaced with a new unit, or only a component in the unit may be replaced with a new one.

When these components are unitized, accuracy of the positioning of these components is improved and efficiency of the work is increased. The heating roller 3, the fixing roller 4, the abutting member 40, and the fixing belt 2 may individually be separated from the second supporting member 38 instead of being integrally separated. In this case, it is advantageous to replace only a component which needs to be replaced, for example, a component that has a short life, such as the fixing belt 2. The pressure roller 5 is attachable to and detachable from the first supporting member 39, while the first supporting member 39 is separated from the main body of the fixing device 1. However, the pressure roller 5 may be configured such that it is attachable to and detachable from the first supporting member 39, while the first supporting member 39 is attached to the main body of the fixing device 1. The first supporting member 39 may be configured such that it is fixedly provided on the fixing device 1. With the above-described attachable/detachable configuration, a comparatively expensive component, such as the fixing belt 2 and the pressure roller 5 can be easily replaced with new ones without damaging them.

The fixing device 1 is provided such that it can be slid out/into the image forming apparatus 20. The fixing device 1 is separated from a main body of the image forming apparatus 20 by sliding it out of the image forming apparatus with the handle 37. Therefore, maintenance work of the fixing device 1 is performed while the fixing device 1 is separated from the main body of the image forming apparatus 20, resulting in a easy maintenance.

The first and second supporting members 39 and 38 are biased in a direction in which they are brought closer together by a resilient member (not shown), such as a spring. Thus, the pressure roller 5 and the fixing roller 4 are biased in a direction of press-contacting each other with a pressing force of equal to 10 kgf or greater. The pressure roller 5 is in pressure-contact with the fixing roller 4 such that an angle, formed between a line connecting the shaft centers of the fixing roller 4 and the heating roller 3 and a line connecting the shaft centers of the fixing roller 4 and the pressure roller 5, is an acute angle. With this arrangement, two fixing regions, i.e., first and second fixing regions 15 and 16, are formed in a fixing area where a toner image is fixed onto a sheet-like recording medium. In the first fixing region 15, the pressure roller 5 does not contact the fixing roller 4, but contacts the fixing belt 2. In the second fixing region 16, the pressure roller 5 is in pressure-contact with the fixing roller 4 via the fixing belt 2.

Figure 3:
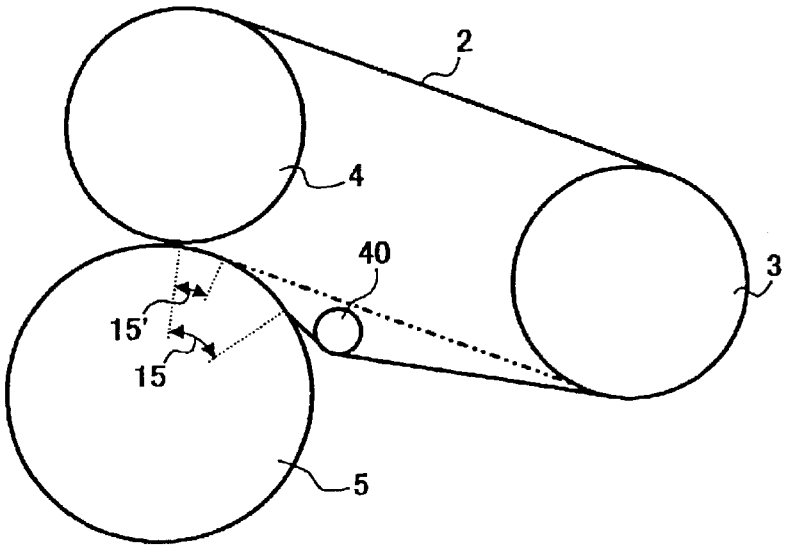
FIG. 3 is a schematic drawing illustrating a first fixing region and an abutting member.

The abutting member 40 is provided at a position between an upstream side of the fixing roller 4 and a downstream side of the pressure roller 3 in the moving direction of the fixing belt 2 as is indicated by an arrow "C" in FIG. 2. Further, the abutting member 40 is arranged such that it abuts against the inner side of the fixing belt 2, i.e., a side in which the heating roller 3 and the fixing roller 4 are provided. As illustrated in FIG. 3, with the arrangement of the abutting member 40, a width of the first fixing region 15 is expanded as compared to the first fixing region 15' formed when the abutting member 40 is not provided.

The casing 33 is provided at a position opposed to the transfer device 22. As illustrated in FIG. 2, the casing 33 includes an inlet 34 and an outlet 35. The inlet 34 receives a sheet-like recording medium conveyed from the transfer device 22. The outlet 35 is arranged at the opposite side of the inlet 34 having the first and second fixing regions 15 and 16 therebetween. The sheet-like recording medium onto which a toner image has been fixed is discharged from the outlet 35. The base of the inlet guide 12 is fixed to the external surface of the casing 33 in the downward direction of the inlet 34. A tip portion of the inlet guide 12 goes into the inside of the casing 33 from the inlet 34 and is extended toward the first fixing region 15.

Figure 4:
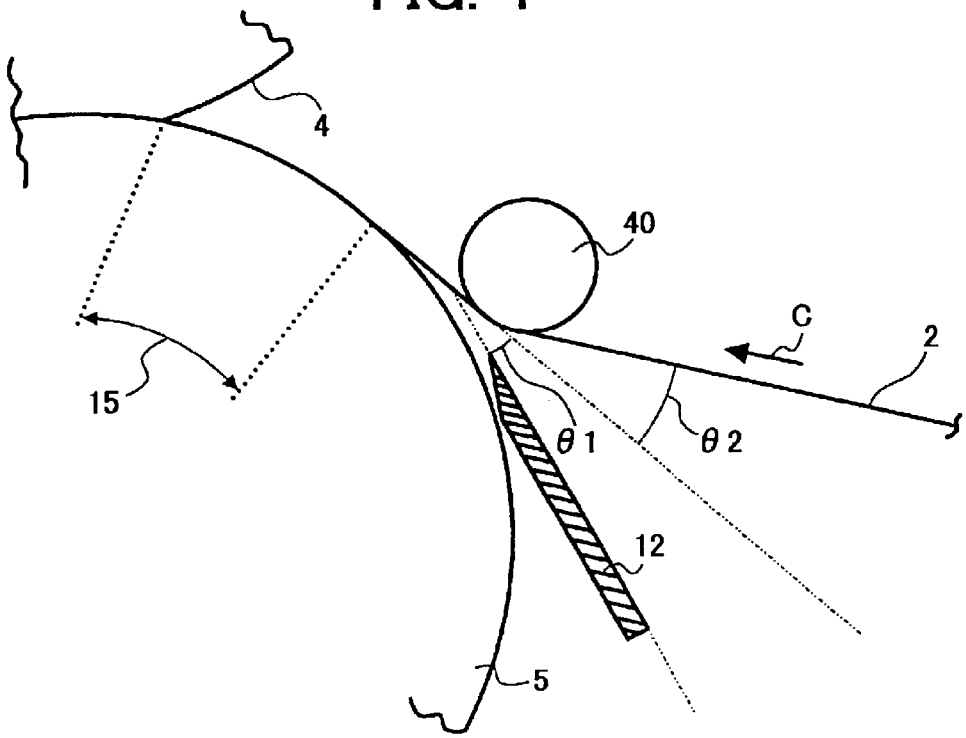
FIG. 4 is an enlarged view illustrating angles set to prevent a rubbing of a toner image.

As illustrated in FIG. 4, an angle $\theta 1$, formed between the approaching direction of the sheet-like recording medium that is regulated by the inlet guide 12 and a line tangential to an upstream end of the first fixing region 15 in the moving direction of the fixing belt 2 indicated by the arrow "C," is equal to 20° or larger. The abutting member 40 is supported by the second supporting member 38 such that it bends the fixing belt 2. An angle $\theta 2$, formed between a spanned direction of the fixing belt 2 spanned between the pressure roller 5 and the abutting member 40 and a spanned direction of the fixing belt 2 spanning between the abutting member 40 and the heating roller 3, is equal to 0° or larger. A length of the fixing belt 2, spanning between the abutting member 40 and the heating roller 3, is set to a range of approximately 40 mm to approximately 52 mm.

The abutting member 40 is made of aluminum and is configured to be rotatably driven by a rotation of the fixing belt 2. The diameter of the abutting member 40 is set to be approximately 8 mm in order to make a heat capacity as small as possible because the abutting member 40 absorbs heat from the fixing belt 2 by abutting against the fixing belt 2. Thus, the abutting member 40 is not easily paralleled with the fixing belt 2. Therefore, as described above, the abutting member 40 is arranged at a position where the abutting member 40 does not directly apply pressure to the pressure roller 5 because a sheet-like recording medium becomes wrinkled in a fixing process if the abutting member 40 abuts against the pressure roller 5 via the fixing belt 2.

The abutting member 40 is provided at the above-described position having the above-described value of the angles θ1 and θ2 to prevent a toner image from being disturbed due to a rubbing of the toner image which is caused when the toner image on a sheet-like recording medium touches the fixing belt 2 before the sheet-like recording medium is conveyed to the first fixing region 15. Namely, a portion of the fixing belt 2, which is on an upstream side of the abutting member 40 in the moving direction of the fixing belt 2 indicated by the arrow "C," is separated from a sheet-like recording medium conveying path by arranging the abutting member 40 and the angle θ2 as described above. Thus, the rubbing of the toner image by this portion of the fixing belt 2 is prevented. The closer the abutting member 40 is to the heating roller 3, the greater the chance of the toner image rubbing against the fixing belt 2, which is caused at a position between the abutting member 40 and the pressure roller 5. However, the rubbing of the toner image in this position is prevented because the abutting member 40 is provided adjacent to the pressure roller 5, and the angle θ1 is set to the above-described value. Further, the spanning direction of the fixing belt 2 is precisely positioned by the first and second supporting members 39 and 38, which is an additional factor to prevent the toner image from be rubbed. The width of the first fixing region 15 is expanded by having the abutting member 40, resulting in a improved fixing performance.

Figure 5:
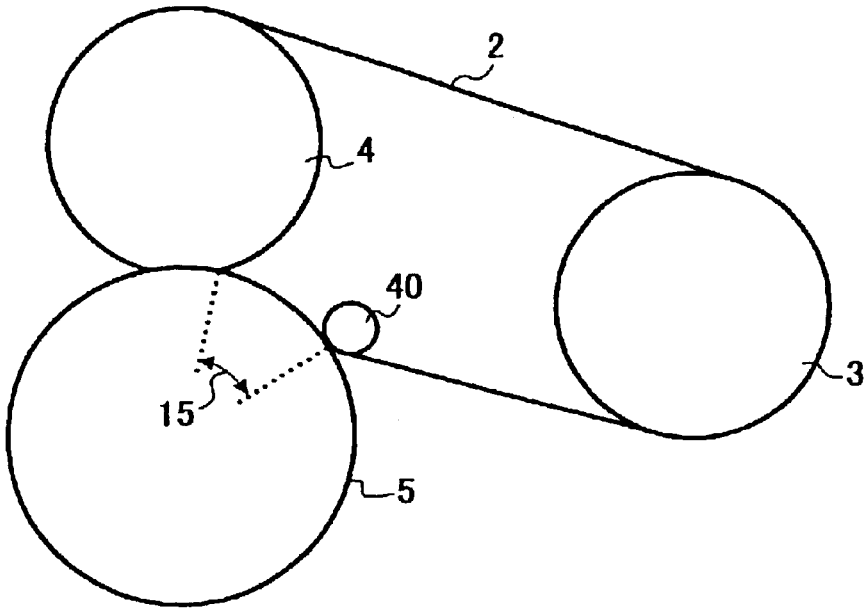
FIG. 5 is a schematic drawing illustrating another example of the abutting member in which the abutting member is arranged at a different position.
Figure 6:
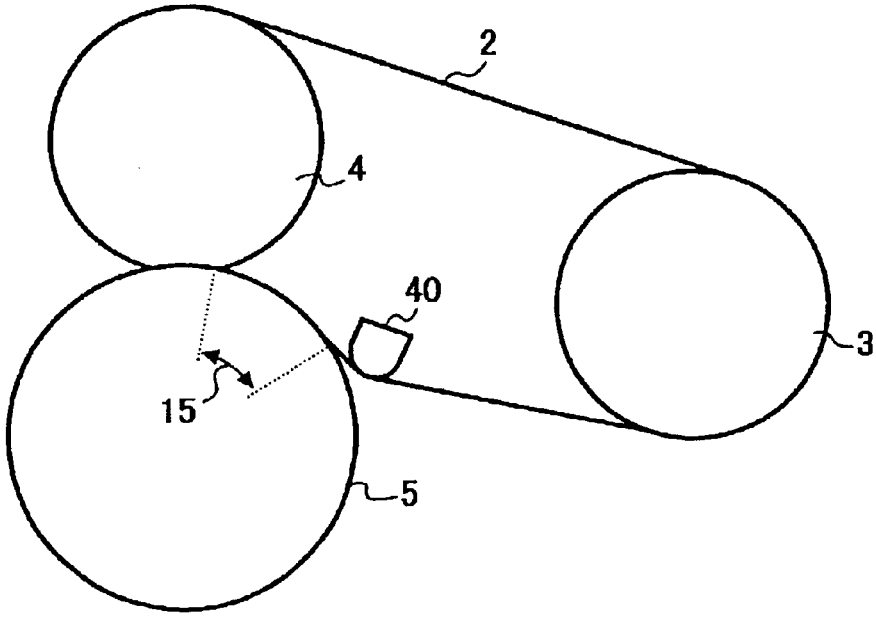
FIG. 6 is a schematic drawing illustrating another example of the abutting member in which the abutting member is differently configured.

As illustrated in FIG. 5, the abutting member 40 may be arranged such that it abuts against the pressure roller 5 via the fixing belt 2 if a sagging of the fixing belt 2 is prevented and the abutting member 40 positioned so as to be parallel with the fixing belt 2. Further, as illustrated in FIG. 6, the abutting member 40 may be formed in a blade-shape as long as an abutting portion of the abutting member 40 is smooth. Furthermore, if rubbing of the toner image is prevented without providing the abutting member 40, the fixing device 1 may be configured such that the θ1 (see FIG. 4) is set to equal to 20° or more and/or the first and second supporting members 39 and 38 are used without including the abutting member 40. The fixing belt 2 includes a base member of 100 μm in thickness made of nickel, and a releasing layer of 200 μm in thickness made of silicone rubber layered on the base member. The fixing belt 2 has a low thermal capacity and a suitable thermo-response. The length of the fixing belt 2 is set such that the diameter is 60 mm when the fixing belt 2 is made into a circle. The base member may be made of stainless steel or polyamide. The thickness of the base member may be in a range of about 30 μm to 150 μm considering its flexibility. When silicone rubber is employed for the releasing layer, the thickness of the releasing layer is preferably in a range of about 50 μm to 300 μm. When fluoro-resin is employed for the releasing layer, the thickness of the releasing layer is preferably in a range of about 10 μm to 50 μm. The releasing layer may have alternative structure in which fluoro-resin is layered on silicone rubber. The fixing belt 2 is required to have a property such that the fixing belt 2 is quickly heated up and the surface of the fixing belt 2 is self-cooled in a fixing region without causing a hot offset problem in which a part of a fused toner image adheres to the fixing belt 2. On the other hand, the fixing belt 2 is required to have a thermal capacity necessary for fusing and fixing a toner image on a sheet-like recording medium in the fixing region. The above-described material and thickness of the fixing belt 2 meet such required conditions.

Because the heating roller 3 and the fixing roller 4 are biased in a direction in which the heating roller 3 and the fixing roller 4 are moving away from each other, the fixing belt 3 is tensioned with about 3 Kgf. The tension on the fixing belt 2 is adjusted by changing the biasing force of the resilient member (not shown). The tension on the fixing belt 2 may be preferably set in a range of about 1 Kgf (9.8N) to about 3 Kgf (29.4N) for a proper toner image fixing operation.

The heating roller 3 and the pressure roller 5 each include hollow cylindrical core metals such that they provide a low thermal capacity. The diameter "$d_{hr}$" of the core metal of the heating roller 3 is preferably is set at a value which satisfies the equation 20 mm$\leqq d_{hr} \leqq$30 mm, and the thickness "$t_{hr}$" of the core metal of the heating roller 3 is set at a value which satisfies the equation 0.3 mm$\leqq t_{hr} \leqq$2.0 mm. The diameter "$d_{pr}$" of the core metal of the pressure roller 5 is preferably is set at a value which satisfies the equation 30 mm$\leqq d_{pr} \leqq$50 mm, and the thickness "$t_{pr}$" of the core metal of the pressure roller 5 is set at a value which satisfies the equation 0.3 mm$\leqq t_{pr} \leqq$1.5 mm. Thus, the thermal capacity of the heating roller 3 is set to approximately 26 cal/° C. or less, and the thermal capacity of the pressure roller 5 is set to approximately 36 cal/° C. or less.

In this example of the present invention, the core metal of the heating roller 3 is made of aluminum. The diameter "$d_{hr}$" of the core metal of the heating roller 3 is set to approximately 30 mm and the thickness "$t_{hr}$" of the core metal of the heating roller 3 is set to approximately 0.7 mm. The material of the core metal preferably has a low specific heat and high thermal conductivity. In place of aluminum, metals, such as iron, copper, stainless, etc., may be employed. For example, when the diameter "$d_{hr}$" of aluminum core metal of the heating roller 3 is 30 mm, the thickness "$t_{hr}$" of the aluminum core metal of the heating roller 3 may be set in a range of about 0.6 mm to 1.4 mm. When the diameter "$d_{hr}$" of iron core metal of the heating roller 3 is 20 mm, the thickness "$t_{hr}$" of the iron core metal of the heating roller 3 may be set in a range of about 0.7 mm to 1.4 mm. When the diameter "$d_{hr}$" of iron core metal of the heating roller 3 is 30 mm, the thickness "$t_{hr}$" of the iron core metal of the heating roller 3 may be set in a range of about 0.3 mm to 0.9 mm. The reason why the thickness "$t_{hr}$" of the core metal is made smaller as the diameter "$d_{hr}$" thereof is increased is that the distortion of the heating roller 3 in the axial direction thereof is prevented.

The above-described lower limit value of the thickness "$t_{hr}$" of the core metal represents an allowable level of value to prevent a deformation of the heating roller 3 caused by the above-described tension of the fixing belt 2. The higher limit value of the thickness "$t_{hr}$" of the core metal of the heating roller 3 represents an allowable level of value to accomplish a desired warm-up time. The reason why the diameter "$d_{hr}$" of the core metal is set to 20 mm or larger is that the required tension of the fixing belt 2 is maintained and that the distortion of the heating roller 3 in the axial direction thereof is prevented. Further, the reason why the diameter "$d_{hr}$" of the core metal is set in the range of 20 mm to 30 mm is to have the thermal capacity of about 26 cal/° C. so as to maintain the fixing belt 2 at a constant temperature required for a fixing operation even when a continuous fixing operation is performed with a conveying speed of a sheet-like recording medium at equal to 200 mm/s or lower.

When the heating roller 3 has a low thermal capacity, the heating roller 3 does not largely absorb heat from the fixing belt 2 even when the fixing belt 2 is rotated, thereby preventing ill effects on fixing performance and preventing the requirement of a longer period of time for a warm-up operation. In addition, even if the temperature is decreased, for example, by the continuous fixing operation, the time required to recover the temperature is shortened. The heater 6 heats the heating roller 3 and the fixing belt 2 via the heating roller 3. A temperature of the heater 6 is input to a controller (not shown) as a signal to be detected by the thermistor 8. The input temperature is compared with a target fixing temperature. When the detected temperature is lower than the target fixing temperature, energization of the heater 6 is performed. When the detected temperature is higher than the target fixing temperature, the energization of the heater 6 is stopped. The fixing temperature is controlled based on the detection of the thermistor 8, and the surface temperature of the fixing belt 2 is maintained at 110° C. or higher. The thermistor 8 abuts against the heating roller 3 with an obtuse angle in the rotating direction of the heating roller 3 so as to reduce abrasion caused by friction between the thermistor 8 and the heating roller 3 produced when the heating roller 3 is rotated.

The heating roller 3 includes a hard protective layer made of alumite layered on the outer surface thereof. The alumite layer is formed by an anode electric field process, having the VICKERS hardness equal to HV200 or greater. The layer of alumite prevents the abrasion of the heating roller 3 produced by the friction between the heating roller 3 and the fixing belt 3. No flaking of the aluminum is observed by an experiment even when image forming operations are performed 60,000 times. A black alumite layer may be formed on the inner surface of the heating roller 3 by an alumite treatment. With this arrangement, a reflection of heat of the heater 6 in the inner surface of the heating roller 3 is prevented. Thus, a heat absorption coefficient of the heating roller 3 is increased, thereby preventing damage caused to the heating roller 3 due to an excessive increase of a temperature by the heater 6. The black alumite treatment of the inner surface of the heating roller 3 can be performed at the same when the alumite layer is formed on the outer surface of the heating roller 3.

The elastic layer 10 of the fixing roller 4 includes a rubber layer made of rubber. More specifically, the material of the rubber of the rubber layer is silicone sponge rubber in the form of a foam. The diameter of the bubble is set to 500 $\mu$m. Especially, the diameter of the bubble in the vicinity of the surface of the fixing roller 4, i.e., in the vicinity of the four periphery planes of the fixing roller 4, is set to 300 $\mu$m or less. Because the elastic layer 10 is in the form of a foam, a reduction in the temperature of the fixing operation is suppressed. Inconvenience, such as an unsatisfactory glossy finish due to an insufficient fixing pressure, an uneven glossy finish due to surface roughness, etc., may be caused because the elastic layer 10 is in the form of a foam. However, such inconvenience is obviated by arranging the diameter of the bubble as described above.

The elastic layer 10, according to the example of the present invention, is molded by mixing a blowing agent into a rubber material in a mold for making the foam. Thus, a non-foam layer (i.e., a so-called "skin layer"), having the thickness of about 1 mm, is formed on the surface of the elastic layer 10. The elastic layer 10 is configured such that the degree of the foaming is increased on the order of the bubble formed in an inner portion of the layer. The vicinity of the surface of the fixing roller 4, in which the diameter of the bubble is set to 300 $\mu$m or less, represents a portion of the surface of the elastic layer 10 that exerts an influence on the uneven glossy finish due to its roughness. The elastic layer 10 may be molded without having the above-described "skin layer." With this arrangement, accuracy of the outer diameter is improved, resulting in a decrease in costs. The elastic layer 10, without the "skin layer," may be molded with the bubbles having the same diameters as those of described above and is used in the fixing device 1.

The surface hardness of the elastic layer 10 is set to 20 HS or greater when measured by an "ASKER C" method (i.e., a method of measuring a hardness). When the surface hardness of the elastic layer 10 is equal to 20 HS or greater, the surface roughness of the elastic layer 10 due to the foam does not affect image quality regardless of whether the elastic layer 10 includes the skin layer or not. Thus, a satisfactory image is produced without having the uneven glossy finish. The outer diameter of the fixing roller 4 is set to 30 mm. The elastic layer 10 includes a heat-resistant and porous elastic member having low thermal conductivity. Thus, the fixing roller 4 does not largely absorb heat from the fixing belt 2, thereby minimizing a decrease in the temperature of the fixing belt 2 after the warm-up operation is completed. Further, a period of time required for a pre-rotation of the fixing belt 2 to recover the temperature is reduced. Because the elastic layer 10 has a comparatively low hardness, a sufficient nip width is secured even if a pressing force of the pressure roller 5 is small. Thus, a high fixing performance is accomplished even under a low-temperature and low-pressure condition.

The core metal of the pressure roller 5 is made of iron. The diameter of the core metal of the pressure roller 5 is set to 40 mm and the thickness thereof is set to 1.0 mm. The material of the core metal preferably has a low specific heat and high thermal conductivity. Metals, such as aluminum, copper, stainless, etc., may be employed in place of iron. For example, when the diameter of iron core metal of the pressure roller 5 is 30 mm, the thickness of the core metal may be set in a range of about 0.4 mm to 1.0 mm. When the diameter of iron core metal of the pressure roller 5 is 50 mm, the thickness of the core metal may be set in a range of about 0.3 mm to 0.8 mm. When the diameter of aluminum core metal of the pressure roller 5 is 30 mm, the thickness of the core metal may be set in a range of about 1.3 mm to 1.5 mm. When the diameter of aluminum core metal of the pressure roller 5 is 50 mm, the thickness of the core metal may be set in a range of about 0.6 mm to 1.2 mm. The reason why the thickness of the core metal is made smaller as the diameter thereof is increased is that the distortion of the pressure roller 5 in the axial direction thereof is prevented.

The above-described lower limit value of the thickness of the core metal represents an allowable level of value in which to prevent a deformation of the pressure roller 5 caused by the pressure of 0.6 Kg/cm2 corresponding to the lower limit value of the fixing pressure. The higher limit value of the thickness of the core metal of the pressure roller 5 represents an allowable level of value in which to accomplish a desired warm-up time. The reason why the diameter of the core metal is set to 30 mm or larger is that the required fixing pressure is maintained and that the distortion of the pressure roller 5 in the axial direction thereof is prevented. Further, the reason why the diameter of the core metal is set in the range of 30 mm to 50 mm is to have a thermal capacity of about 26 cal/° C. so as to maintain the fixing belt 2 at a constant temperature required for a fixing operation even when a continuous fixing operation is performed.

When the pressure roller 5 has a low thermal capacity, the pressure roller 5 does not largely absorb heat from the fixing belt 2 even when the fixing belt 2 is rotated. According to the example of the present invention, the pressure roller 5 includes the heater 7, thereby preventing ill effects exerted on a fixing performance due to a decrease in the temperature of the fixing belt 2 and a longer period of time required for the warm-up operation is prevented. Further, even if the temperature is decreased, for example, by the continuous fixing operation, the time required to recover the temperature is shortened. The heater 7 heats the pressure roller 5 to shorten the warm-up time and supplies heat to the underside of a sheet-like recording medium in a fixing operation to achieve a stable fixing performance. In addition, the pressure roller 5 may include a releasing layer in a range of about 10 μm to 300 μm in thickness layered on the core metal. The heater 7 heats the pressure roller 5. A temperature of the heater 7 is input to a controller (not shown) as a signal to be detected by a thermistor (not shown). Energization of the heater 7 is controlled to maintain the pressure roller 5 at a target temperature in a similar manner to that of the heater 6. The thermistor (not shown) abuts against the pressure roller 5 with an obtuse angle in the rotating direction of the pressure roller 5 so as to reduce abrasion caused by friction between the thermistor (not shown) and the pressure roller 5 produced when the heating roller 3 is rotated.

The reason why the thickness of the heating roller 3 and the pressure roller 5 is minimized, such that they have a low thermal capacity, is that the fixing belt 2 is employed in the fixing device 1. Because the fixing operation is performed in the comparatively long region, i.e., in the first and second fixing regions 15 and 16, the fixing pressure is reduced, and strength of the pressure roller 5 is decreased. Further, because the pressure roller 3 is not in pressure-contact with the heating roller 3, the thickness of the heating roller 3 and the pressure roller 5 is kept to a minimum. As described above, because the fixing operation is performed in the comparatively long region, the fixing operation is performed with a comparatively low temperature, thereby reducing the period of time required for the warm-up operation. Further, when the fixing belt 2 is employed, the fixing belt 2, which is heated by a heater, is cooled down to a suitable temperature for the fixing operation, while the fixing belt 2 is rotated, thereby preventing a hot offset problem. An output of the heaters 6 and 7 is set to 700 W or less, considering a current passes when a power switch is turned on or a flicker of a fluorescent lamp occurs when the heater is turned on or off.

The cleaning roller 31 is arranged at a position adjacent to the coating roller 32, while the cleaning roller 31 is positioned at an upstream side of the coating roller 32 in the moving direction of the fixing belt 2. Both the cleaning roller 31 and the coating roller 32 abut against the fixing belt 2. The diameter of the cleaning roller 31 is set to 20 mm. The cleaning roller 31 is driven by a driving device (not shown) to move in an opposite direction in which the fixing belt 3 moves at a position opposed to the fixing belt 3. With this arrangement, the cleaning roller 31 scrapes toner transferred onto the fixing belt 2 from a sheet-like recording medium. The scraped toner is wiped off the surface of the cleaning roller 31 by a cleaning device (not shown) such that a cleaning performance of the cleaning roller 31 is maintained. The coating roller 32 applies a release agent to the fixing belt 2. The releasing agent includes silicone oil as a main component. The diameter of the coating roller 32 is set to 16 mm. The coating roller 32 is driven by the fixing belt 2. The coating roller 32 abuts against a release agent supplying device and a blade (not shown) such that a thickness of a layer of the release agent, supplied from the release agent supplying device, is made uniform. Thus, an appropriate amount of the release agent is applied to the fixing belt 2.

The fixing device 1 includes: a plurality of fixing modes, which are selected based on the type of toner to be used; a resolution of the toner image to be formed; and the type of the sheet-like recording medium to be used. According to the example of the present invention, the type of toner includes black toner used in the image forming device 21BK or black, cyan, yellow, and magenta toner used in the image forming devices 21BK, 21C, 21Y, and 21M, respectively. Namely, the type of the toner represents either that for forming a black-and-white image or that for forming a full color image. The resolution of the toner image includes resolution of 600 dpi and 1200 dpi (dot per inch). The type of the sheet-like recording medium includes the above-described normal recording medium or special recording medium. Thus, the fixing device 1 includes 8 fixing modes in combination with the above-described conditions.

A temperature for a fixing operation (i.e., the target temperature) and a conveying speed of the fixing belt 2 for conveying a sheet-like recording medium are set according to the fixing condition. The fixing temperature includes temperatures of 160° C., 150° C., and 130° C. The conveying speed includes speed of 185 mm/s, 125 mm/s, and 62.5 mm/s. The conveying speed is adjusted by adjusting the rotational speed of the fixing roller 4.

In the image forming device 21BK, a writing operation with the two beams is performed in the fixing mode in which the conveying speed of the fixing belt 2 is 185 mm/s. A sheet-like recording medium is conveyed at this fast speed because the writing operation is performed with the two beams. The conveying speed of 185 mm/s is the limitative speed that is determined by the maximum rotating speed of a polygon mirror provided in the image forming device 21BK. Because a cost is increased to employ the image forming device having the two-beam writing mechanism, the writing operation with the two beams is performed only in the image forming device 21BK for a black-and-white print which is most frequently used.

When a full color toner image is formed, a writing operation with one beam is performed in the image forming device 21BK, like the writing operation performed in the other image forming devices 21C, 21Y, and 21M. When a toner image with 600 dpi resolution is formed, the conveying speed of the fixing belt 2 is set to 125 mm/s. When a toner image with 1200 dpi resolution is formed, the conveying speed of the fixing belt 2 is set to 62.5 mm/s. The fixing temperature is set to the highest value for each conveying speed in a range in which a hot offset problem is not caused. This arrangement of the fixing temperature is advantageous for a full color image forming operation because when the full color image is formed, it is preferable that the image has a high degree of glossiness. Then, large amount of heat is required to have a high degree of glossiness of the image. Because the special recording medium generally has a larger thermal capacity than that of the normal recording medium, the amount of heat supplied is increased by conveying the special recording medium at a low speed or by increasing the fixing temperature, when the special recording medium is used. Especially, when a cardboard is used as the recording medium, the conveying speed is set to 62.5 mm/s.

According to the example of the present invention, a selection of the fixing mode, which involves a selection of a type of toner, is made automatically based on information about an image of an original document. However, the selection of the fixing mode may be made by a user by pressing a key, which is provided in an operation panel (not shown) of the main body of the image forming apparatus 20, corresponding to a black-and-white print or a full color print. A selection of the fixing mode, which involves a selection of a resolution of a toner image, is made automatically based on information about an image of an original document. However, the selection of the fixing mode may be made by the user, namely, the user selects the resolution of the toner image of 600 dpi or 1200 dpi by pressing a corresponding key.

According to the example of the present invention, a selection of a fixing mode that involves a selection of a type of a sheet-like recording medium is made automatically with a commonly know device by determining whether or not the sheet-like recording medium is a normal or a special type before the recording medium is conveyed to the fixing device 1. The determination of the special recording medium may be made when a specific sheet feeding cassette is used. Further, the selection of the fixing mode that involves the selection of the sheet-like recording medium may be made by the user by pressing a key provided in the operation panel (not shown) of the main body of the image forming apparatus 20. The user may designate the sheet feeding cassette to be used by pressing a key in the operation panel. A control device (not shown) then automatically determines whether the used sheet-like recording medium is the normal or special type so as to switch the fixing mode accordingly.

When the fixing mode is switched, energization of the heater 6 is started when the switched fixing mode requires a fixing temperature (T2) higher than that required for the previous mode (T1). When the thermistor 8 detects the fixing temperature (T2), the fixing belt 2 starts a pre-rotation. After the thermistor 8 detects again the fixing temperature (T2), the fixing belt 2 starts to convey the sheet-like recording medium. The pre-rotation of the fixing belt 2 is performed to effectively heat the overall fixing belt 2. When the fixing mode is switched, the energization of the heater 6 is stopped when the switched fixing mode requires a fixing temperature (T2) lower than that required for the previous mode (T1). The fixing belt 2 then starts the pre-rotation. After the thermistor 8 detects the fixing temperature (T2), the fixing belt 2 starts to convey the sheet-like recording medium. The pre-rotation of the fixing belt 2 is performed to effectively reduce the temperature of the fixing belt 2 by promoting a heat radiation of the fixing belt 2. The pre-rotation speed of the fixing belt 2 is set to 125 mm/s which is in common with one of the moving speeds of the fixing belt 2 in the fixing operation.

A period of time, in which the fixing belt 2 pre-rotates when the fixing mode is switched from one mode to another mode, is approximately constant due to a relationship between (T1) and (T2). Thus, the pre-rotation of the fixing belt 2 is performed for the period of time determined by the relationship between (T1) and (T2), i.e., the period of time determined based on the switched mode and the previous mode. The conveyance of the sheet-like recording medium is then started after the pre-rotation of the fixing belt 2 has been performed for the determined period of time. When the switching of the fixing mode is made between the fixing modes in which the fixing temperature is set to 150° C. and 160° C., the pre-rotation of the fixing belt 2 is not performed because the difference in the value of the temperature is not significant. Further, a less period of time is required for the pre-rotation of the fixing belt 2 in a case where the switched mode requires a higher fixing temperature than that of the previous mode, i.e., (T1)<(T2), compared with a case where the switched mode requires a lower fixing temperature than that of the previous mode, i.e., (T1)>(T2), because the heat radiation of the fixing belt 2 is performed less efficiently than the heating operation of the heater 6.

The reason why the fixing temperature is controlled with one of the three temperatures, the conveyance speed of the sheet-like recording medium is controlled with one of the three speeds, and the pre-rotation time of the fixing belt 2 is controlled with one of four periods of time is to make the control simple. However, the fixing temperature, the conveyance speed, and the pre-rotation time may be controlled with values other than those described above according to the selected fixing mode. The fixing mode is not necessarily determined by the type of the toner, the resolution of the toner image, and the type of the sheet-like recording medium. The fixing mode may be determined in combination with a part of these parameters. Further, only one of the fixing temperature and the conveying speed of the sheet-like recording medium may be controlled instead of both of them being controlled.

With the above-described configuration, when the image forming apparatus 20 is turned on, the energization of the heater 6 and the pre-rotation of the fixing belt 2 are performed based on the detection result of the thermistor 8. Thus, a start-up operation is completed so that the apparatus is ready for an image forming operation. When a switching of the fixing mode is made, a switching of the energization of the heater 6, and a predetermined pre-rotation of the fixing belt 2 are performed to complete the start-up operation. Thus, the apparatus is ready for the image forming operation. When an operator performs a commonly known operation for starting an image forming apparatus, the photoconductive drum 25Y rotates in a direction indicated by the arrow "A" in FIG. 1. The photoconductive drum 25Y is then charged by a charging device (not shown) and is exposed with the exposure light 29Y to form an electrostatic latent image thereon corresponding to an original image. The electrostatic latent image is developed by a developing device (not shown).

A sheet-like recording sheet fed from either the sheet feeding cassette 23 or 24 and conveyed either by the pickup roller 41 or 42 is conveyed to the registration roller 30 via the roller mechanism 44 by the conveying roller 43. The registration roller 30 adjusts a time to convey the sheet-like recording medium to the transfer device 22 so that the sheet-like recording medium is in precise registration with a toner image formed on the surface of the photoconductive element 25Y. The toner image is transferred onto the sheet-like recording medium conveyed on the transfer device 22 in a direction indicated by the arrow "B". Residual toner remaining on the surface of the photoconductive element 25Y is scraped by a cleaning device (not shown) after the transfer operation is completed for the following image forming operation.

The sheet-like recording medium, onto which the yellow toner image is transferred, is conveyed by the transfer device 22 in the direction indicated by the arrow "B" so that magenta, cyan, and black toner images are transferred thereon one after the other. The sheet-like recording medium is conveyed to a fixing region, while being guided by the inlet guide 12, after all of the toner color images are transferred.

The sheet-like recording medium is then conveyed to the first fixing region 15. The toner image, formed on the surface of the sheet-like recording medium, does not contact the fixing belt 2 when the sheet-like recording medium is conveyed to the first fixing region 15. The toner image transferred onto the sheet-like recording medium is fused by heat and pressure under a temperature controlled by the selected fixing mode in the first and second fixing regions 15 and 16. More specifically, the transferred toner image is gradually fused by the heat of the fixing belt 2 in the first fixing region 15 such that the toner image is provisionally fixed onto the sheet-like recording medium. The provisionally fixed toner image is then fixed on the sheet-like recording medium completely in the second fixing region 16 by the pressure applied by the fixing roller 3 and the pressure roller 5. Because the material, degree of the foaming, and surface hardness of the elastic layer 10 are arranged as described above and the heater 7 heats the pressure roller 5 to a degree in which a hot offset problem does not occur, an appropriate fixing operation is performed even if repeated fixing operations are performed. Thus, the fixing operation is not interrupted and the pressure roller 5 is heated again. After the fixing operation is completed, the sheet-like recording medium is discharged to the sheet discharging tray 27 from the sheet discharging outlet 46 via the conveying roller 43 and the discharging roller 45.

In a fixing device using a pair of heating rollers, a nip formed by the pair of the heating rollers is generally narrow due to a limited width of the nip. Thus, a high fixing temperature is required to have a sufficient amount of heat in the narrow fixing region. In this case, a recording medium and toner are quickly heated which generally causes a hot offset problem . In the belt-type fixing device according to the example of the present invention, a length of a fixing region must be sufficiently long to perform a proper fixing operation. Because a sufficient amount of heat for the fixing operation is secured in this fixing device within a range in which fixing quality is not reduced by, for example, the hot offset problem, a glossiness of an image (i.e., a HAZE value) is improved especially when the image is fixed onto an overhead transparency film sheet because a surface of the overhead transparency film sheet becomes flat which prevents diffused reflection. Further, absorption and scatter of penetrating light in the toner is prevented, resulting in a satisfactory image forming performance.

The fixing device according to the example of the present invention and the image forming apparatus using the fixing device are described above. However, a heater may be provided only to a heating roller instead of providing the heater to both a pressure roller and the heating roller. A thermistor may be arranged at any position in a region between the position opposing the heating roller via a fixing belt and the position where it is prior to the fixing region in a moving direction of the fixing belt. The thickness and material of the fixing belt, and the diameters, thicknesses, and materials of the pressure and heating rollers may be appropriately selected. The fixing operation may be performed only in a region where the pressure roller sis in pressure-contact with the fixing roller via the fixing belt, if the heating roller and the pressure roller have a low thermal capacity and the fixing operation is properly performed. The image forming apparatus, according to the example of the present invention, can form a black-and-white image, as well as a full color image. However, the image forming apparatus may be configured such that only a single color image is formed.

Obviously, numerous additional modifications and variations of the present invention are possible in light of the above teachings. It is therefore to be understood that within the scope of the appended claims, the present invention may be practiced otherwise than as specifically described herein.

What is claimed:

1. A fixing device comprising:

a fixing belt configured to be endless and to convey a sheet-like recording medium on which a toner image is fixed;

a heating roller configured to support a first end of the fixing belt therearound;

a fixing roller configured to support a second end of the fixing belt therearound;

a pressure roller provided at a position opposed to the fixing roller so that the fixing belt is passed between the pressure roller and the fixing roller;

a first supporting member configured to support the pressure roller with respect to a main body of the fixing device;

a second supporting member configured to support the fixing belt, the heating roller, and the fixing roller with respect to the first supporting member;

an angle, formed between a line tangential to an upstream end of a contacting region of the fixing belt with the pressure roller in a moving direction of the fixing belt and an approaching direction of a sheet-like recording medium to the upstream end of the contacting region of the fixing belt with the pressure roller, which is set equal to 20° or larger; and a guiding member configured to guide the sheet-like recording medium by regulating the approaching direction of the sheet-like recording medium, wherein the second supporting member is pivoted about the fixing roller with respect to the first supporting member, while supporting the fixing belt, the heating roller, and the fixing roller.

2. The fixing device according to claim 1, wherein at least the second supporting member is attachable to and detachable from the main body of the fixing device, while the fixing belt, the heating roller, and the fixing roller are supported by the second supporting member.

3. The fixing device according to claim 1, wherein the fixing belt, the heating roller, and the fixing roller are attachable to and detachable from the second supporting member, while the second supporting member is detached from the main body of the fixing device.

4. An image forming apparatus comprising:

an image forming device configured to form an image; and a fixing device including:

a fixing belt configured to be endless and to convey a sheet-like recording medium on which a toner image is fixed;

a heating roller configured to support a first end of the fixing belt therearound;

a fixing roller configured to support a second end of the fixing belt therearound;

a pressure roller provided at a position opposed to the fixing roller such that the fixing belt is passed between the pressure roller and the fixing roller;

a first supporting member configured to support the pressure roller with respect to a main body of the fixing device;

a second supporting member configured to support the fixing belt, the heating roller, and the fixing roller with respect to the first supporting member;

an angle, formed between a line tangential to an upstream end of a contacting region of the fixing belt with the pressure roller in a moving direction of the fixing belt and an approaching direction of a sheet-like recording medium to the upstream end of the contacting region of the fixing belt with the pressure roller, which is set equal to 20° or larger; and a guiding member configured to guide the sheet-like recording medium by regulating the approaching direction of the sheet-like recording mediums wherein the second supporting member is pivoted about the fixing roller with respect to the first supporting member, while supporting the fixing belt, the heating roller, and the fixing roller.

5. A fixing device comprising:

a fixing belt means, which is formed to be endless, for conveying a sheet-like recording medium on which a toner image is fixed;

a heating roller means for supporting a first end of the fixing belt means therearound;

a fixing roller means for supporting a second end of the fixing belt means therearound;

a pressure roller means for pressure-contacting the heating roller means, the pressure roller means being provided at a position opposed to the fixing roller means such that the fixing belt means is located between the pressure roller means and the fixing roller means;

a first supporting means for supporting the pressure roller means with respect to a main body of the fixing device;

a second supporting means for supporting the fixing belt means, the heating roller means, and the fixing roller means with respect to the first supporting means;

an angle, formed between a line tangential to an upstream end of a contacting region of the fixing belt means with the pressure roller means in a moving direction of the fixing belt means and an approaching direction of a sheet-like recording medium to the upstream end of the contacting region of the fixing belt means with the pressure roller means, which is set equal to 20° or larger; and a guiding means for guiding the sheet-like recording medium by regulating the approaching direction of the sheet-like recording medium, wherein the second supporting means is pivoted about the fixing roller means with respect to the first supporting means, while supporting the fixing belt means, the heating roller means, and the fixing roller means.

6. The fixing device according to claim 5, wherein at least the second supporting means is attachable to and detachable from the main body of the fixing device, while the fixing belt means, the heating roller means, and the fixing roller means are supported by the second supporting means.

7. The fixing device according to claim 5, wherein the fixing belt means, the heating roller means, and the fixing roller means are attachable to and detachable from the second supporting means, while the second supporting means is detached from the main body of the fixing device.

8. An image forming apparatus comprising:

an image forming device configured to form an image; and a fixing device including:

a fixing belt means, which is formed to be endless, for conveying a sheet-like recording medium on which a toner image is fixed;

a heating roller means for supporting a first end of the fixing belt means therearound;

a fixing roller means for supporting a second end of the fixing belt means therearound;

a pressure roller means for pressure-contacting the heating roller means, the pressure roller means being provided at a position opposed to the fixing roller means such that the fixing belt means is located between the pressure roller means and the fixing roller means;

a first supporting means for supporting the pressure roller means with respect to a main body of the fixing device;

a second supporting means for supporting the fixing belt means, the heating roller means, and the fixing roller means with respect to the first supporting means are provided;

an angle, formed between a line tangential to an upstream end of a contacting region of the fixing belt means with the pressure roller means in a moving direction of the fixing belt means and an approaching direction of a sheet-like recording medium to the upstream end of the contacting region of the fixing belt means with the pressure roller means, which is set equal to 20° or larger; and a guiding means for guiding the sheet-like recording medium by regulating the approaching direction of the sheet-like recording medium, wherein the second supporting means is pivoted about the fixing roller means with respect to the first supporting means, while supporting the fixing belt means, the heating roller means, and the fixing roller means.

* * * * *

UNITED STATES PATENT AND TRADEMARK OFFICE

CERTIFICATE OF CORRECTION

PATENT NO. : 6,785,505 B2
DATED : August 31, 2004
INVENTOR(S) : Yasui et al.

It is certified that error appears in the above-identified patent and that said Letters Patent is hereby corrected as shown below:

Title page,
Items [45] and [*], should read:
-- [45] Date of Patent: *Aug. 31, 2004

[*] Notice: Subject to any disclaimer the term of this patent is extended of adjusted under 35 U.S.C. 154(b) by 0 days.

This Patent is subject to a terminal disclaimer. --

Signed and Sealed this

Fourteenth Day of December, 2004

JON W. DUDAS
*Director of the United States Patent and Trademark Office*